United States Patent [19]

O'Reilly

[11] 4,134,457

[45] Jan. 16, 1979

[54] EMERGENCY FIREMAN LIFE-SUPPORT DEVICE

[76] Inventor: Raymond F. O'Reilly, 2 Elderbury La., Valley Stream, N.Y. 11581

[21] Appl. No.: 757,381

[22] Filed: Jan. 6, 1977

[51] Int. Cl.[2] ..... A62C 31/00

[52] U.S. Cl. ..... 169/16; 239/305; 137/605

[58] Field of Search ..... 239/305, 304; 137/561, 137/604, 605, 606; 169/5, 16, 24

[56] References Cited

U.S. PATENT DOCUMENTS

| | | | |
|---|---|---|---|
| 2,943,797 | 7/1960 | Neilson | 239/305 X |
| 3,276,628 | 10/1966 | Clive | 239/304 UX |
| 3,317,142 | 5/1967 | Casale | 239/305 X |
| 3,504,858 | 4/1970 | Liddiard | 239/305 X |
| 3,878,896 | 4/1975 | White | 239/304 X |

*Primary Examiner*—Alan Cohan

[57] ABSTRACT

In a preferred embodiment of the invention, a fire truck is provided with an adapter for connecting the fire hose to the truck water-pump outlet, and extending from the adapter is an air conduit connected to a compressed-air source for alternate use of the same hose to pump air therethrough as from bottled breathable compressed air whereby trapped firemen may be furnished breathable air through the fire hose normally in their presence, by a mere switching-off the water-valve and opening the air-valve.

1 Claim, 4 Drawing Figures

EMERGENCY FIREMAN LIFE-SUPPORT DEVICE

This invention relates to a life-saving emergency device for fire engine trucks.

BACKGROUND TO THE INVENTION

Prior to the present invention, there at times occur situations when one or more firemen within a burning structure find themselves at least momentarily trapped by collapsing structures and/or by encompassing fire, such constituting grave threats at their survival, and too often firemen are either severely injured or killed for lack of breathable air. Also, when advancing a fire hose within a burning structure, particularly when having to climb a stairs, several firemen are required to lift the very heavy water-filled hose, thus making advance slow and drudgerous as well as requiring the attention of so many firemen. In the situations where firemen become trapped, even if there is enough available air present, communication with outside help is sometimes lost by virtue of broken radio or otherwise being devoid of radio communications. Following the placing under control a fire, valuable out-of-service additional time is lost by the necessity to stretch-out and press all hose to thereby expel residual water therefrom prior to the retraction and storage of the hose on the fire truck.

SUMMARY OF THE INVENTION

Accordingly, objects of the present invention include the overcoming and/or avoiding of one or more of the above-noted problems and difficulties and hazards.

In particular, an object is to provide a device for conveniently and speedily furnishing breathable air and/or oxygen to area(s) devoid of such, to sustain life on an emergency basis.

Another object is to provide a device for conveniently and speedily establishing or re-establishing communication with trapped firemen.

Another object is to provide a device for intermittently eliminating the excessive weight of a fire hose during an advance thereof and/or during a climbing of a ladder or stairs therewith.

Another object is to provide a device for effectively and speedily evacuating water from a fire hose preparatory to storing the hose on the fire truck, and accordingly, to thereby provide for reduced out-of-service time required for a truck to get-back into service after a fire requiring use of the hoses.

Other objects become apparent from the preceding and following disclosure.

Broadly the invention may be defined as a conduit such as preferably a fire truck hose, a liquid source such as a fire truck water pump mechanism and outlet thereof, normally having the inlet of the hose connected thereto, and an alternate-use gas source such as an air pump and/or compression tank on the fire truck for blowing-out the hose(s), or — if for breathable air, compressed breathable air and/or oxygen, for example; by appropriate valve mechanism, the water is turned-off and the gas is turned-on, or alternately, the gas is turned-off and the water is turned-on, as the circumstances and need may require. Preferably the air conduit may alternately be plugged in the receptacle for breathable air or oxygen when such is needed, and alternately, on other occasions be plugged into an air-pump receptacle — or compression storage tank for such air-pump.

In another embodiment, an air-pump outlet conduit may be modified by an appropriate adapter such that a hose may be removed from a water-pump and alternately screwed onto the air adapter for the flushing thereof with pumped air.

In the embodiment having an adapter from which an air conduit extends to an air and/or oxygen source, a liquid trap is mounted in air-flow series to prevent water from accidentally backing-up into the air-hose beyond the liquid trap.

In order for the various adapters to be practical and adaptable for large-scale use at low cost and minimum adjustments to existing fire truck equipment, the adapter preferably screws or otherwise attaches to the truck in the same manner as a conventional fire hose inlet end structure, and has an adapter outlet structure of a structure to receive and attach to a conventional fire hose inlet end structure.

Conduit structure of bottled air, oxygen or the like, includes an appropriate and/or conventional pressure-reducing valve, for reducing pressure such as from typically about 1980 PSI down to about 75 PSI normally.

The invention may be better understood by making reference to the following Figures.

THE FIGURES

DETAILED DESCRIPTION OF THE INVENTION

Figure 4:
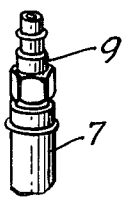
FIG. 4 illustrates the male and female jacks of the air conduit mechanism of FIG. 1 embodiement, in side view.
Figure 1:
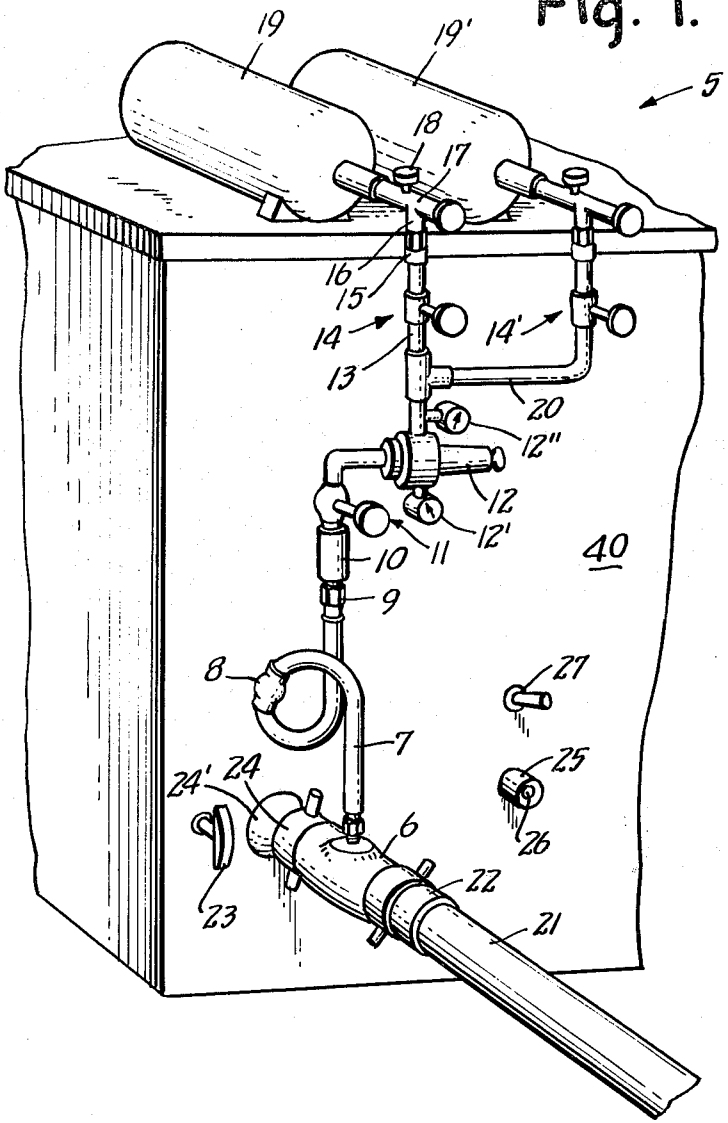
FIG. 1 illustrates a perspective in-part view of a preferred embodiment of the present invention, representative of structure of a fire truck.

In greater detail, FIGS. 1 and 4 illustrate one preferred embodiment of the invention, disclosing in FIG. 1 a liquid and gas-handling conduit device 5. A major component is the T-shaped valve adapter 6, which could as well be Y-shaped or the like, having an outlet male-threaded end—the same as is shown for the different FIG. 3 adapter having male threaded portion 36, such that the hose 21 may be attached conventionally by its female-threaded (not shown, but conventional) attaching element 34 of hose inlet 22. The inlet element 24 of adapter 6 is female threaded the same as the FIG. 3 female element 42 which has female threads 41. The inlet element 24 attaches by its female threads to a male element mounted on the truck, as male element 24 having male threads the same as the FIG. 3 threads 36. From the adapter 6 extends air conduit 7 having a back-flow liquid check-valve 8 mounted intermediate of sections of the air conduit, in flow series therewith. The air conduit 7 has attaching element 9 which mates with element 10 as illustrated also in FIG. 4 in exploded view. The element 9 also is designed to correspondingly alternately mate with the air-source element 25 having passage 26 through which air-pump compressed air is furnished; off-on air valve 11 controls flow of gas from the bottled compressed gas source, while switch arm 27 controls off-on gas (air) flow from the pump-compressor source through air passage 26. Bottled breathable air and/or oxygen or the like, passes a pressure-reducing valve 12 which reduces pressure from typically about 1980 PSI to about 75 PSI as indicated by pressure gauge 12' on the downstream side of the valve, a pressure gauge 12" on the downstream side of the valve, a pressure gauge 12" on the upstream side of the valve. The compressed gas(es) are channeled through one or more alternate source-conduits such as conduit 13 and/or conduit 20, for example. From a particular single-source conduit such as 13, there is an appropriate off-on valve such as valve mechanism 14 such that individual bottles 19 may be removed and replaced while other bottles are still in use and furnishing compressed gas, as typically through conduit 20 even though valve mechanism 14 is in an off-state. Bottled gas conduit 16 is attached by conventional attaching elements 15, for channeling flow from conduit 17 past valve 18, for example. It is to be understood that these latter noted various valves and minor and/or short conduits may vary from one type of bottle to another, within the scope of the invention.

FIG. 1 illustrates typically a fire truck-mounted system on the face of a fire truck body 40.

Figure 2:
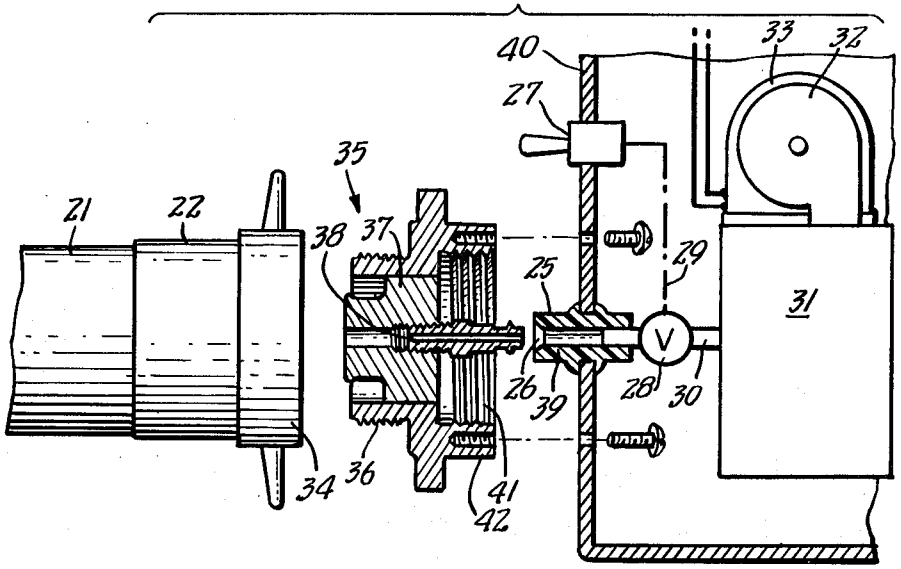
FIG. 2 illustrates an in-part exploded side cross-sectional view of a fire hose and pump-outlet adapter and pump-outlet, together with diagrammatic representation of a pump compression tank and a pump and driving motor thereof.
Figure 3:
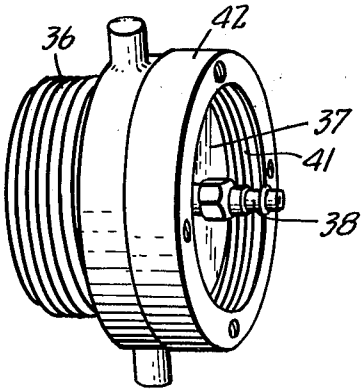
FIG. 3 illustrates in side-back perspective view, the pump-outlet adapter of the FIG. 2 embodiment.

FIGS. 2 and 3 illustrate an alternate adapter element for the same hose and same air-source element 25. In this embodiment, the adapter is mounted—as shown in FIG. 2, on the face of the truck body 40. The adapter element 35 is connected to the truck body 40 by a plurality of screws. The adapter also has internal screw threads 41 so that it may be used optionally as a conventional connector where desired. Screw threads 36 are for connection to hose connector 34. The press-fit member 37 mounts the air-element 38 for mating with element 25.

Accordingly, by utilization of any one or more embodiments of the invention, water may be pushed-out of a line, and/or breathable air may be furnished through the line (fire hose), and or after air-flushing the hose may be utilized for communication, or the waterless hose be easily handled and/or mounted quickly into storage onto the fire truck.

It is with the scope of the invention to make such variations and or modifications, and/or substitution of equivalents as would be apparent to a person of ordinary skill.

I claim:

1. In a fire fighting vehicle having a fire fighting water outlet with a coupling, the improvement comprising:

a portable fitting having an inlet for detachable connection to said coupling and an outlet for detachable connection to a fire fighting hose, a second inlet to said fitting having a check valve therein, a valved portable source of air under pressure connected to said second inlet whereby said fire fighting hose may be cleared of water and air may be delivered to the hose outlet by cutting off the water outlet at the vehicle and opening the valve from the air source.

* * * * *